US010036154B2

(12) United States Patent
Crevier

(10) Patent No.: US 10,036,154 B2
(45) Date of Patent: Jul. 31, 2018

(54) URINAL ANTI-SPLASH DEVICE

(71) Applicant: Jeffrey Scott Crevier, Fort Lauderdale, FL (US)

(72) Inventor: Jeffrey Scott Crevier, Fort Lauderdale, FL (US)

( * ) Notice: Subject to any disclaimer, the term of this patent is extended or adjusted under 35 U.S.C. 154(b) by 0 days.

(21) Appl. No.: 15/342,543

(22) Filed: Nov. 3, 2016

(65) Prior Publication Data

US 2018/0119403 A1 May 3, 2018

(51) Int. Cl.
*E03D 9/00* (2006.01)
*E03D 13/00* (2006.01)

(52) U.S. Cl.
CPC ..... *E03D 13/005* (2013.01)

(58) Field of Classification Search
CPC ..... E03D 9/00
USPC ..... 4/300.3
See application file for complete search history.

(56) References Cited

U.S. PATENT DOCUMENTS 4,671,976 A * 6/1987 Vidal ..... A47K 1/14 4/286
4,866,793 A * 9/1989 Luedtke ..... E03D 9/00 4/300.3
D329,893 S * 9/1992 Luedtke ..... E03D 9/00 D23/310
5,313,672 A * 5/1994 Luedtke ..... E03D 9/00 4/144.1
5,398,347 A * 3/1995 Luedtke ..... E03D 9/00 4/300.3
D393,896 S * 4/1998 Wagner ..... E03D 9/00 D23/261
5,774,905 A * 7/1998 Wager ..... E03D 13/00 4/222.1
5,809,590 A * 9/1998 Williams ..... A47K 11/12 4/300.3
D427,295 S * 6/2000 Wagner ..... A47K 11/12 D23/307
6,550,075 B1 * 4/2003 Brannon ..... A47K 13/24 4/300.3
D639,410 S * 6/2011 Ramirez ..... A47K 17/00 D23/310
8,043,498 B2 * 10/2011 Rueda ..... E03F 1/00 210/164
8,056,153 B2 * 11/2011 Ruedas ..... E03D 13/00 4/222

(Continued)

*Primary Examiner* — Lori Baker
(74) *Attorney, Agent, or Firm* — The Concept Law Group; Scott D. Smiley; Scott M. Garrett

(57) ABSTRACT

A urinal anti-splash device including an anti-splash body sized and shaped to couple to at least a portion of a urinal. The anti-splash body may include a first portion, a second portion opposite the first portion, a longitudinal length extending from the first portion to the second portion, and an upper surface extending the longitudinal length. The urinal anti-splash device also includes a base coupled to the first portion and configured to extend in a direction substantially perpendicular from the first portion. The urinal anti-splash device further includes a first plurality of protrusions extending outwardly from the upper surface of the anti-splash body and a second plurality of protrusions extending outwardly from the base, the second plurality of protrusions configured to extend in the direction substantially perpendicular from the first portion of the anti-splash body.

20 Claims, 8 Drawing Sheets

(56) References Cited

U.S. PATENT DOCUMENTS

| | | | | |
|---|---|---|---|---|
| D678,482 | S * | 3/2013 | Williams | E03D 9/00 D23/261 |
| 8,856,976 | B1 * | 10/2014 | Niedzielski | E03D 9/00 4/300.3 |
| 8,856,977 | B2 * | 10/2014 | Ramirez | E03D 13/00 4/309 |
| D787,031 | S * | 5/2017 | Morgan-Williams | D23/307 |
| 2004/0093662 | A1 * | 5/2004 | Zhu | A47K 17/00 4/300.3 |
| 2013/0000027 | A1 * | 1/2013 | San Luis | E03D 9/00 4/300.3 |
| 2015/0047114 | A1 * | 2/2015 | Ramirez | E03D 13/00 4/300.3 |
| 2015/0143624 | A1 * | 5/2015 | Irving | E03D 9/00 4/300.3 |

* cited by examiner

URINAL ANTI-SPLASH DEVICE

FIELD OF THE INVENTION

The present invention relates generally to urinal accessories, and, more particularly, relates to a urinal anti-splash device for placement within a urinal.

BACKGROUND OF THE INVENTION

A urinal, often installed for efficiency when compared to a general purpose toilet, is a sanitary plumbing fixture commonly located in male restrooms. The use of a urinal, in comparison to a general purpose toilet, is often more convenient for a user due to the absence of additional doors and locks. As an added convenience, urinals do not require a user to turn up a seat prior to use, which is both convenient and generally more sanitary than the toilet. Moreover, urinals occupy less space and consume less water per flush, or possibly no water at all, than a toilet which requires flushing.

Devices designed to be placed within urinals are well-known. For example, urinals found in public restrooms often have a plastic mesh guard to prevent large debris from entering the drain. Unfortunately, such plastic mesh guards fail to reduce or prevent the splashing of urine onto the user. In fact, such plastic mesh guards may actually increase the risk of the user being splashed by the urine as the urine ricochets from the plastic mesh guard. Moreover, these plastic mesh guards do not prevent the splashing of urine that is directed towards the back wall of the urinal.

Other known devices designed to be placed within urinals, often referred to as urinal screens or occasionally as urinal mats, are sized and shaped to cover either the urinal's back wall or the drain. Such urinal screens do not allow the user the option of covering both the back wall and the drain to prevent the urine from splashing onto the user from a maximum surface area of the urinal. Moreover, some urinal screens are made of a rigid material that may fail to conform to the various sizes and shapes of urinals.

Additional known devices designed for placement within a urinal often include protrusions that are densely compacted together, preventing a urine stream from flowing in a vertical direction toward the urinal screen. In this vein, such devices rely on the protrusions to break up the urine stream, leaving urine deposited on the protrusions, resulting in an unpleasant odor and the need for increased cleaning frequency of the device. Moreover, many urinal screens include urinal cakes or deodorizers which require costly and frequent replacement.

Therefore, a need exists to overcome the problems with the prior art as discussed above.

SUMMARY OF THE INVENTION

The invention provides a urinal anti-splash device that overcomes the hereinafore-mentioned disadvantages of the heretofore-known devices and methods of this general type and that provides a urinal anti-splash device sized and shaped to mate with a urinal back wall and a urinal screen to prevent urine from splashing on a user when urine is deposited in the direction of the urinal back wall and/or the urinal screen.

With the foregoing and other objects in view, there is provided, in accordance with the invention, a urinal anti-splash device including an anti-splash body sized and shaped to couple to at least a portion of a urinal, the anti-splash body having a first portion, a second portion opposite the first portion, a length extending from the first portion to the second portion, an upper surface extending the length, a base couplable to the first portion and configured to extend in a direction substantially perpendicular from the first portion, a first plurality of protrusions extending outwardly from the upper surface of the anti-splash body, and a second plurality of protrusions extending outwardly from the base, the second plurality of protrusions configured to extend in the direction substantially perpendicular from the first portion of the anti-splash body.

In accordance with another feature, an embodiment of the present invention includes the base of a shape different than a shape of the anti-splash body.

In accordance with a further feature of the present invention, the anti-splash body includes an elongated shape of a flexible material configured to couple to a back wall of a urinal.

In accordance with a further feature of the present invention, the urinal anti-splash device includes at least one fastener sized and shaped to orient the anti-splash body in a vertical direction parallel to a vertical direction of a urinal wall.

In accordance with yet another feature of the present invention, the base is removably coupled to the first portion.

In accordance with a further feature of the present invention, the urinal anti-splash device includes a perforated coupling region disposed between the first portion of the anti-splash body and the base, the perforated coupling region configured to translate the base from a first position parallel to the anti-splash body to a second position including the base being in the direction substantially perpendicular from the first portion of the anti-splash body.

In accordance with another feature of the present invention, the base is made of buoyant material.

In accordance with a further feature of the present invention, the anti-splash body is a rectangular-like shape and the base is a circular-like shape.

In accordance with another feature of the present invention, the first plurality of protrusions are of a variable length.

In accordance with another feature of the present invention, the first plurality of protrusions taper downwardly in a direction toward the upper surface of the anti-splash body.

In accordance with yet another feature, an embodiment of the present invention includes the urinal anti-splash device having an anti-splash body configured to couple to a urinal wall, the anti-splash body including a first portion, a second portion opposite the first portion, and a longitudinal length separating the first portion from the second portion, a base couplable to the first portion of the anti-splash body, the base sized and shaped to cover at least a portion of a urinal drain, a coupling region configured to translate the base between a first position including the base oriented in a direction parallel to the anti-splash body and a second position including the base oriented in a direction substantially perpendicular from the base, and a plurality of protrusions coupled to the anti-splash body and the base.

In accordance with another feature of the present invention, the anti-splash body is of a shape different than a shape of the base.

In accordance with a further feature of the present invention, the base is removably coupled to the anti-splash body.

In accordance with a further feature of the present invention, the coupling region includes a perforated edge.

In accordance with another feature of the present invention, the plurality of protrusions taper downwardly in a direction toward an upper surface of the anti-splash body and the base.

In accordance with yet another feature of the present invention, the anti-splash body includes a thermochromic material.

In accordance with the present invention, a method for mounting a urinal anti-splash device within a urinal includes providing a urinal anti-splash device having an anti-splash body sized and shaped to couple to at least a portion of a urinal, the anti-splash body including a first portion, a second portion opposite the first portion, a longitudinal length extending from the first portion to the second portion, and an upper surface extending the longitudinal length, a base couplable to the first portion and configured to extend in a direction substantially perpendicular from the first portion, a first plurality of protrusions extending outwardly from the upper surface of the anti-splash body, and a second plurality of protrusions extending outwardly from the base, the second plurality of protrusions configured to extend in the direction substantially perpendicular from the first portion of the anti-splash body, mounting the anti-splash body within a back wall of a urinal, and placing the base over a urinal screen.

In accordance with another feature of the present invention, the method may include removably coupling the anti-splash body from the base.

In accordance with a further feature of the present invention, the method may include bending the urinal anti-splash device at a location of a perforated coupling region disposed between the first portion of the anti-splash body and the base, the perforated coupling region configured to translate the base from a first position parallel to the anti-splash body to a second position including the base being in the direction substantially perpendicular from the first portion of the anti-splash body.

Although the invention is illustrated and described herein as embodied in a urinal anti-splash device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the body of the urinal anti-splash device in a direction from a ground surface toward a ceiling.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
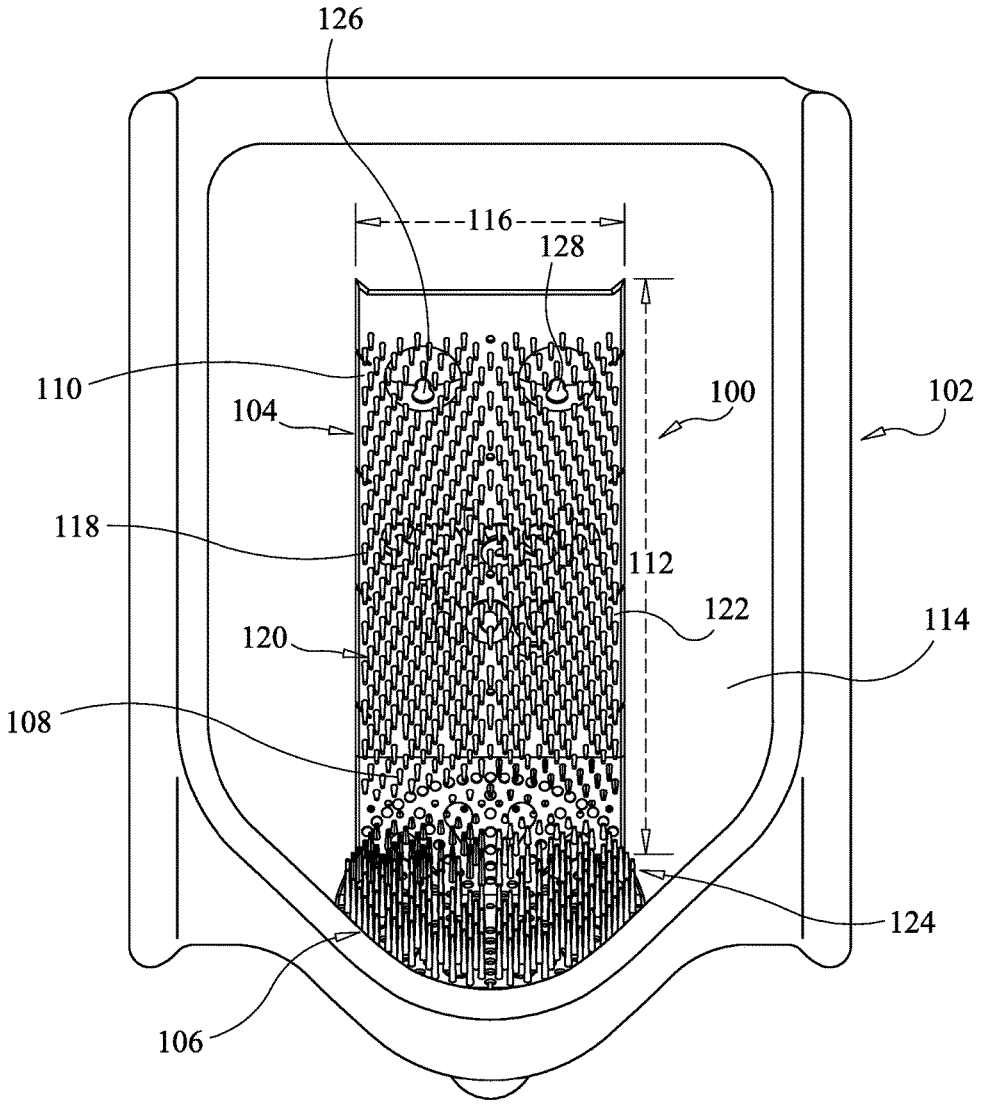
FIG. 1 is an elevational front view of a urinal anti-splash device disposed in a urinal in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient urinal anti-splash device that prevents urine from splashing onto a user when the urine is deposited on the urinal wall, e.g., the urinal back wall, or in a direction toward the urinal drain. Advantageously, the urinal anti-splash device includes an anti-splash body and a base that may be separated from each other to provide a device that conforms to various types of urinals, while simultaneously covering a substantial portion of the overall surface area of the urinal. Embodiments of the invention also provide one or more protrusions that substantially span a longitudinal length of the anti-splash body and define one or more protrusion voids which allow the urine to flow in the direction toward the urinal drain.

Referring now to FIG. 1, one embodiment of the present invention is shown in an elevational front view. FIG. 1 shows several advantageous features of the present invention, but, as will be described below, the invention can be provided in several shapes, sizes, combinations of features and components, and varying numbers and functions of the components. The first example of a urinal anti-splash device 100 placed within a urinal 102, as shown in FIG. 1, includes an anti-splash body 104 coupled to a base 106. In one embodiment, the anti-splash body 104 is sized and shaped to couple to at least a portion of a urinal 102, e.g., a standard sized urinal. The term "urinal" is defined herein in its broadest possible sense as a container or other receptacle normally found in a restroom and may include a standard sized adult urinal, a child's urinal, or the like. The urinal 102 may be of a shape that is, without limitation, rectangular, square, round, oval, or the like. It is understood that the urinal dimensions and shapes described herein are merely exemplary and not intended to be limiting.

In one embodiment, the portion of the urinal 102 configured to receive the anti-splash body 104 is a back wall 114 of the urinal 102. In one embodiment, the back wall 114 may include a height of approximately 17.0-22.0 inches in length and a width that is approximately 9.0-14.0 inches in length. In other embodiments, the urinal 102 may include a length and a width that is outside of this range.

FIG. 1 depicts the anti-splash body 104 having a first portion 108, a second portion 110 opposite the first portion 108, and a length 112, i.e., a longitudinal length, extending from the first portion 108 to the second portion 110. In one embodiment, the length 112 permits the anti-splash body 104 to cover a substantial portion of the back wall 114 of the urinal 102 to prevent urine from splashing on a user when the urine strikes the anti-splash body 104. The term "substantial portion" is defined herein as covering at least 40%-50% of the back wall 114 of the urinal 102. In other embodiments, the length 112 covers less than the substantial portion of the back wall 114 of the urinal 102.

In one embodiment, the anti-splash body 104 includes an elongated shape of a flexible material configured to couple to the urinal 102. The term "elongated" is defined herein as having a length that is at least twice as long as a width. In other embodiments, the length may be less than twice as long as the width. For example, in one embodiment the length 112 is approximately 17.0-20.0 inches. In this embodiment, the anti-splash body may include a width 116 that is approximately 5.0-8.0 inches. In another embodiment, the length 112 may be approximately 13.0-16.0 inches and the width 116 may be approximately 3.0-6.0. In other embodiments, the length 112 and the width 116 may be outside of these ranges.

FIG. 1 depicts the elongated shape of the anti-splash body 104 being a rectangular-like shape. The term "rectangular-like" is defined herein as having at least one pair of opposing parallel sides of equal length. The term "rectangular-like" may encompass round or curved edges. In other embodiments, the anti-splash body 104 may be rectangular, square, round, oval, or another shape conducive for coupling to the back wall 114 of a urinal 102.

In one embodiment, the anti-splash body 104 may be made of a material that is flexible and tough, such as DuPoint Elvax®250, PVC plastic, or the like. In other embodiments, the anti-splash body 104 may be composed of a composite material, a metallic material, or another material conducive for placement within a urinal. The material may or may not have elastically deformable properties (e.g., the ability to change its shape and return back to its static-state shape after its change in shape). In one advantageous embodiment, the material is a buoyant material that provides a base 106 that will rise above the water line where water remains in the urinal after flushing, thereby decreasing the risk of the urinal drain being blocked by the anti-splash device 100. In other embodiments, the material may be a non-buoyant material.

In one embodiment, the urine is prevented from splashing onto the user when striking the anti-splash body 104 at least partly due to a first plurality of protrusions 118 being coupled to an upper surface 120 of the anti-splash body 104. The term "protrusion" is defined herein as a part that extends away from the upper surface 120 and may include bristles, a wave pattern, one or more shapes, e.g., squares, or another configuration designed to prevent urine from splashing onto a user when using the anti-splash device 100. In use, such as when a urine stream strikes the protrusions 118, the urine may be broken apart by the protrusions 118. Said another way, the anti-splash device 100 may not rely on a capillary action to reduce or prevent urine from splashing from the anti-splash device 100 onto a user.

Advantageously, the protrusions 118 define a plurality of protrusion voids 122 which permit the urine to effectively flow in a downward direction along the upper surface 120 toward the lower portion 124 of the urinal 102 which houses the urinal drain. In one embodiment, such as when the device 100 is disposed in a vertical direction with respect to the back wall 114 of the urinal 102, gravity may assist in causing the urine to effectively flow in the downward direction toward the lower portion 124 of the urinal 102. The protrusion voids 122 may also provide space for the protrusions 118 to bend and deflect when struck by the urine.

In order to effectively mount the anti-splash body 104 to the back wall 114, the anti-splash body 104 includes at least one fastener 126 sized and shaped to orient the anti-splash body 104 in the vertical direction parallel to a vertical direction of the back wall 114. FIG. 1 depicts the anti-splash body 104 mounted to the back wall 114 using a first suction cup coupled to the fastener 126 and a second suction cup coupled to a second fastener 128. The fasteners 126, 128 are depicted as apertures defined by the anti-splash body 104. In other embodiments, the fasteners 126, 128 may be adhesive, e.g., tape, hooks, or another type of fastener configured to mount the anti-splash body 104 in a stationary position relative to the back wall 114.

Figure 2:
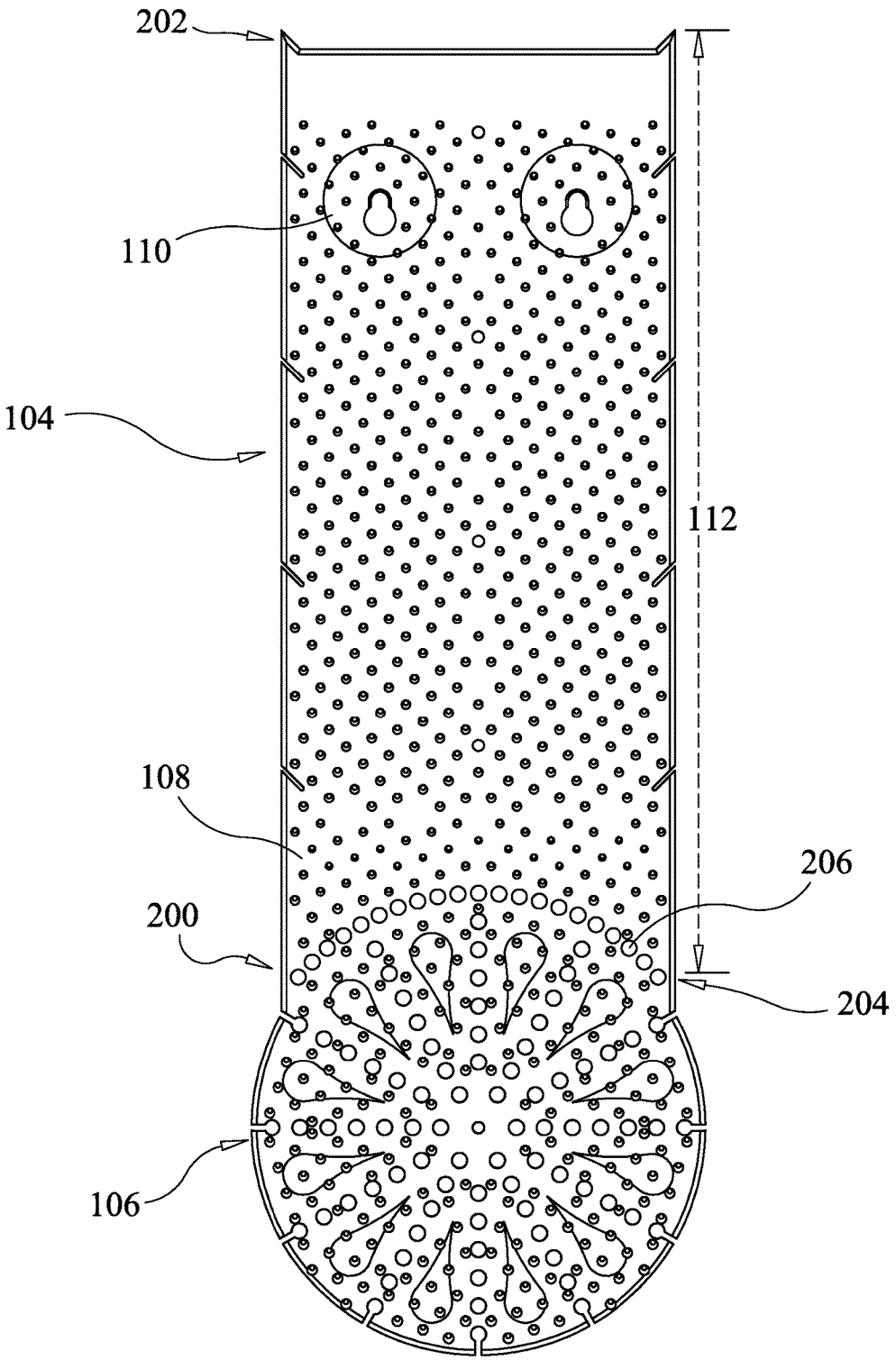
FIG. 2 is an elevational front view of the urinal anti-splash device of FIG. 1 disposed outside of a urinal and depicting a base disposed in a direction substantially parallel to an anti-splash body in accordance with the present invention.

With reference now to FIG. 2, the base 106 is depicted as being coupled to the first portion 108 of the anti-splash body 104. Generally speaking, the first portion 108 includes the region extending approximately from a first end 200 to a midpoint along the length 112. In the same vein, the second portion 110 includes the region extending approximately from a second end 202 to the midpoint along the length 112. The midpoint is generally defined as being disposed approximately halfway between the first end 200 and the second end 202.

Figure 3:
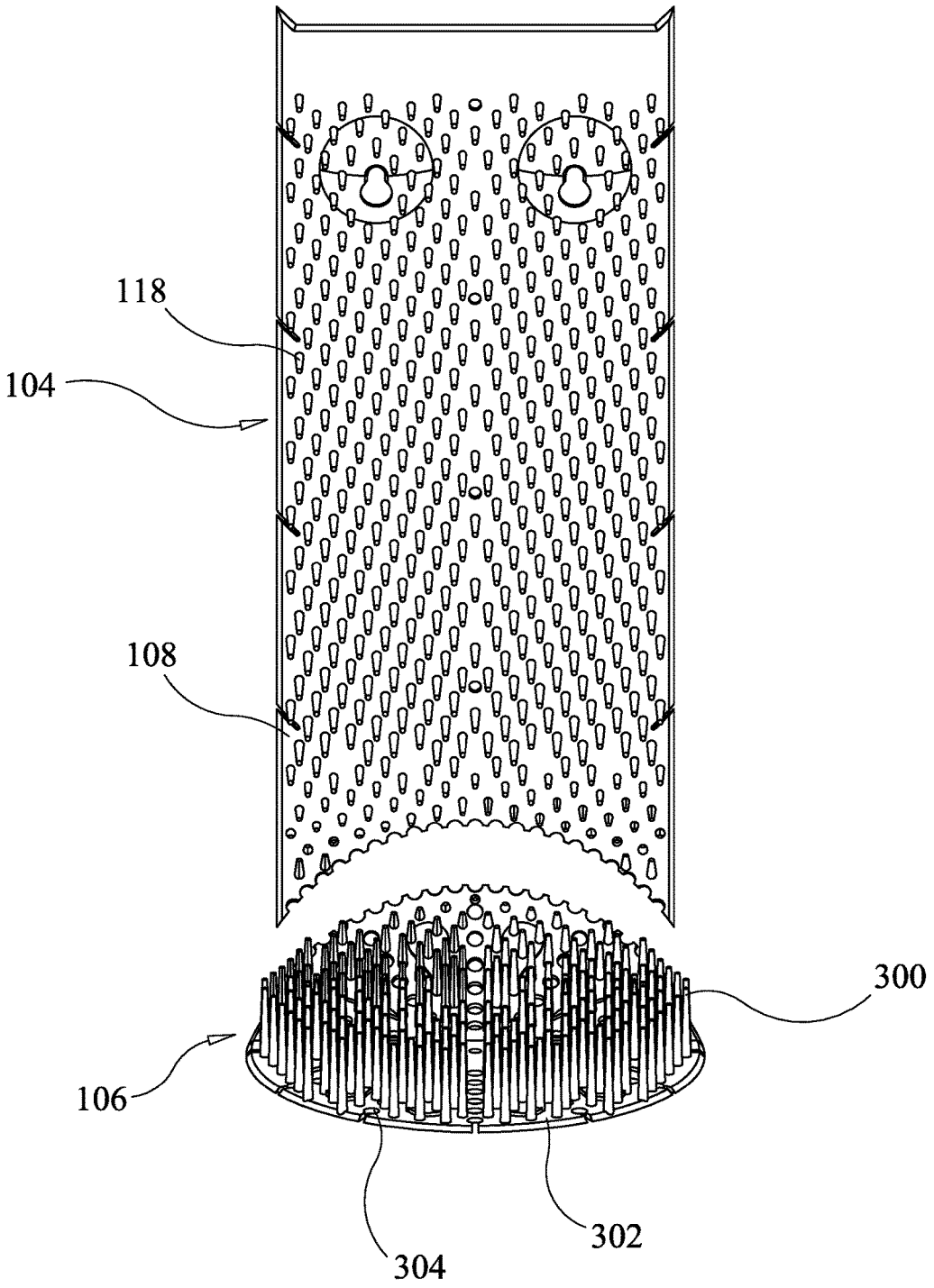
FIG. 3 is an elevational front view of the urinal anti-splash device of FIG. 1 depicting the base uncoupled from and disposed in a direction substantially perpendicular to the anti-splash body in accordance with the present invention.

With brief reference to FIG. 2, in conjunction with FIG. 3, in one advantageous embodiment, in order to effectively separate, e.g., removably couple, the anti-splash body 104 from the base 106 (FIG. 3), the first end 200 includes a perforated coupling region 204 disposed between the first portion 108 and the base 106. More specifically, the perforated coupling region 204 extends from the first portion 108 to the base 106 and includes a perforated edge 206 that facilitates in the ability to simply tear, split, or otherwise separate the first portion 108 of the anti-splash body 104 from the base 106 along the perforated edge 206. The term "perforated" is defined herein as visibly displaying a hole, perforation, puncture, or other visible marking such that the user is provided with a visual indication of where the anti-splash body 104 may be uncoupled, i.e., separated, from the base 106. Said another way, the anti-splash body 104 may be removably coupled from the base 106. Advantageously, the perforated coupling region 204 not only allows the user to remove the base 106 from urinals with raised drainage points, but it also provides the user with the ability to independently move and position the anti-splash body 104 and the base 106 relative to select locations on a urinal.

In one embodiment, the perforated coupling region 204 is configured to translate the base 106 from a first position in which the base 106 is oriented in a direction parallel to the anti-splash body 104 (FIG. 2) to a second position including the base 106 being oriented in a direction substantially perpendicular from the first portion 108 of the anti-splash body 104 (FIG. 3). The term "substantially perpendicular" is defined herein as being disposed at an approximate 90 orientation (+/−15-20°) with respect to the first portion 108. The base 106 may be translated from the first position to the second position when coupled to the anti-splash body 104 or alternatively, when separated from the anti-splash body 104.

With reference again to FIG. 1, the substantially perpendicular orientation of the base 106 enables the user to bend the urinal anti-splash device 100 in accordance with the dimensions of the urinal. In the same vein, this embodiment provides the urinal anti-splash device 100 that covers the urinal's back wall 114 and lower portion 124, thereby reducing or preventing urine from splashing on the user when either or both the back wall 114 and the lower portion 124 are struck by a stream of urine. As an added advantage, the urinal anti-splash device 100 may be made from a single mold, effectively reducing the costs associated with making the urinal anti-splash device 100 in comparison to other existing urinal accessories that may require the manufacturing of separate components. In other embodiments, the anti-splash device 100, e.g., the anti-splash body 104 and the base 106, may be manufactured as separate components.

With reference now to FIG. 3, a second plurality of protrusions 300 can be seen extending outwardly from the base 106. The second plurality of protrusions 300 are configured to extend in the direction substantially perpendicular from the first portion 108 of the anti-splash body 104. This configuration advantageously prevents urine from splashing onto the user when striking the base 106. Similar to the protrusions 118 described above, in use, such as when a urine stream strikes the protrusions 300, the urine may be broken apart by the protrusions 300. Advantageously, the protrusions 300 define a plurality of protrusion voids 302 which permit the urine to effectively flow in the downward direction toward the urinal drain. In order to effectively allow the urine to flow into the urinal drain, the base 106 is depicted as defining a plurality of apertures 304 which define a urine flow path from the base 106 to the urinal drain. The protrusion voids 302 may also give space for the protrusions 300 to bend and deflect when struck by the urine.

Figure 4:
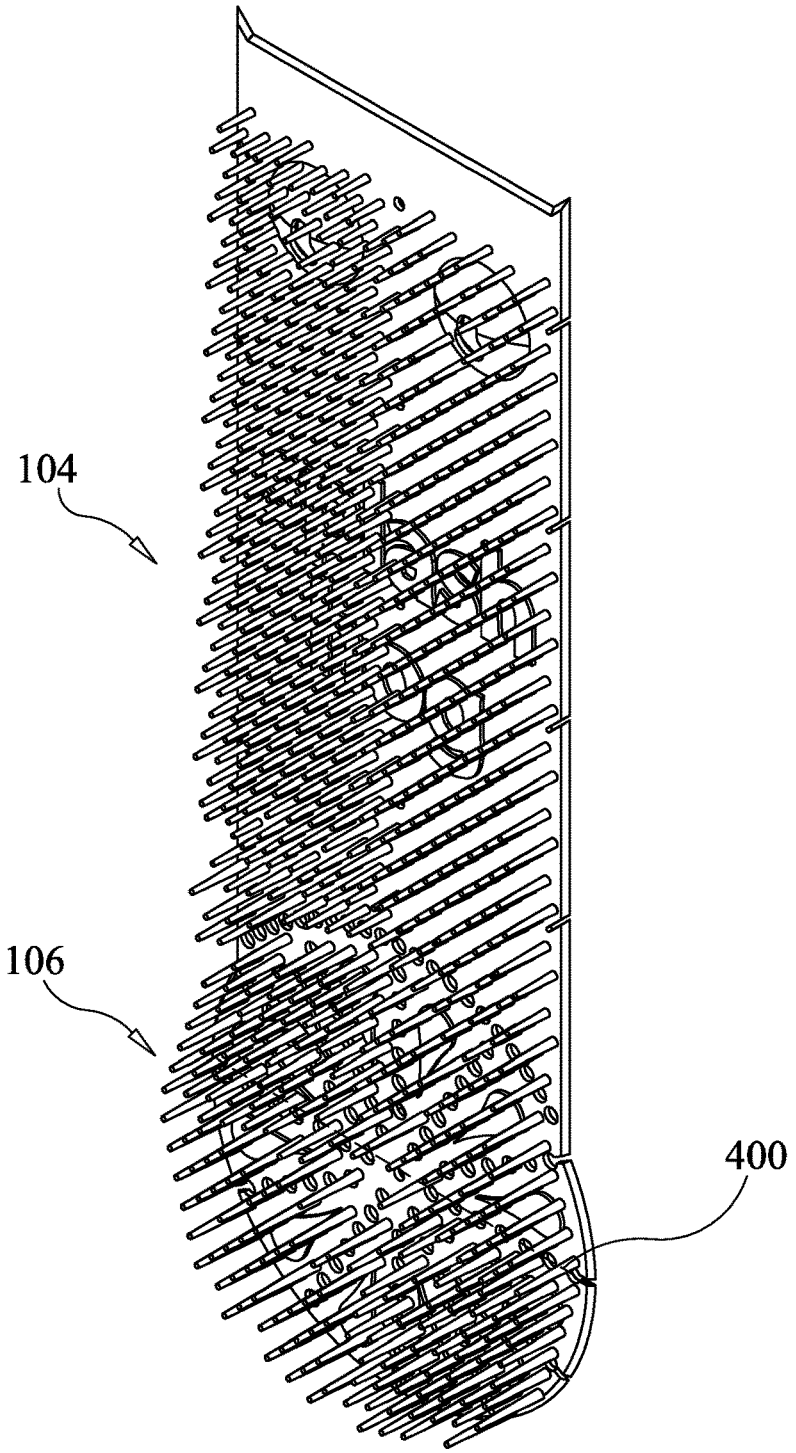
FIG. 4 is a perspective view of the urinal anti-splash device of FIG. 1 depicting further features of the base in accordance with the present invention.

With reference now to FIG. 4, in order to prevent urine from bouncing off of the urinal drain screen in a direction toward the user, the base 106 is sized and shaped to cover at least a portion of the surface area of a urinal drain screen. In one embodiment, the portion may be at least 30% of the surface area of the urinal drain screen. In other embodiments, the base 106 may cover less than the 30% of the surface area of the urinal drain screen. In one non-limiting embodiment the base 106 includes a diameter 400 that is approximately 5.0-7.0 inches in length. In others embodiments, the diameter 400 may be outside of this range.

FIG. 4 depicts the shape of the base 106 as being a circular-like shape, i.e., different than the shape of the anti-splash body 104. The term "circular-like" is defined herein as having at least two round edges. The circular-like shape is conducive for covering the urinal drain which is commonly a circular shape. In other embodiments, the shape of the base 106 and the shape of the anti-splash body 104 may be the same, e.g., rectangular, circular, square, round, oval, or another shape conducive for fitting within the urinal.

Figure 5:
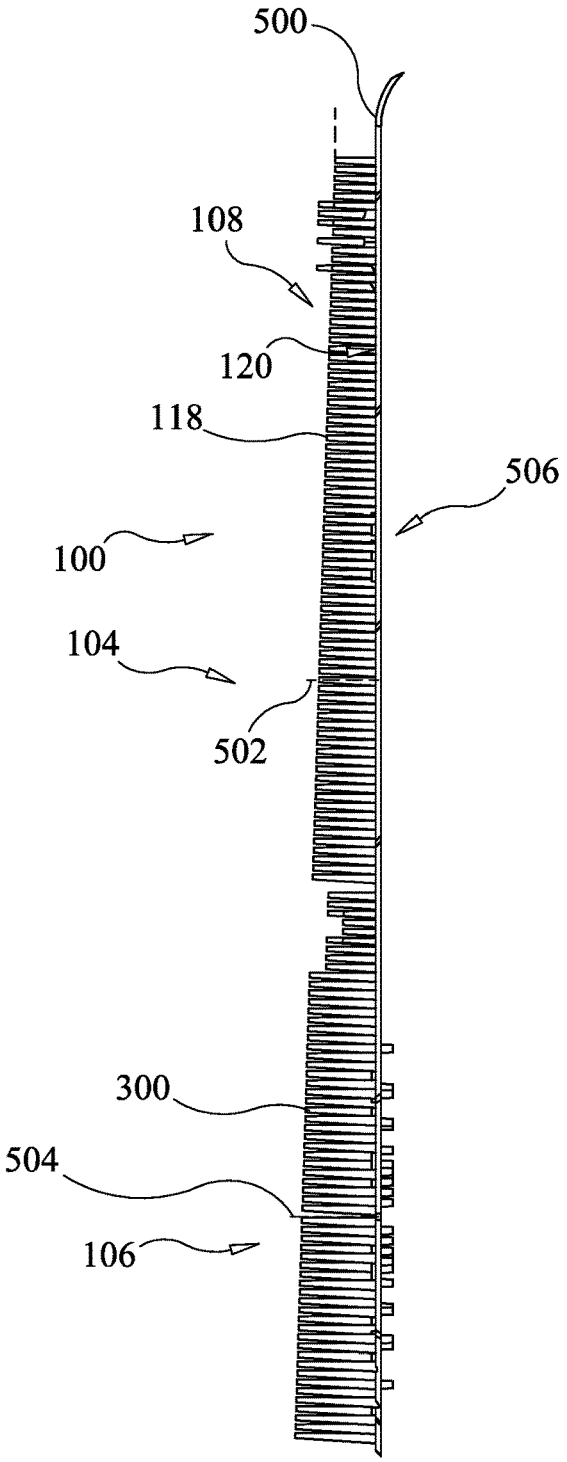
FIG. 5 is an elevational side view of the urinal anti-splash device of FIG. 1 depicting a plurality of protrusions of a variable length in accordance with the present invention.

With reference now to FIG. 5, an elevational side view of the urinal anti-splash device 100 is shown. More specifically, the first portion 108 is depicted having an angled region 500 to facilitate water and/or urine flow along the upper surface 120 in a direction toward the urinal drain. Additionally, the protrusions 118, 300 are depicted as having a variable length which may also increase the facilitation of water and/or urine flow along the upper surface 120 toward the urinal drain. In other embodiments, the protrusions 118 and/or the protrusions 300 may have a uniform length. In one embodiment, the protrusions 118 include a protrusion length 502 that is between approximately 0.25 to 1.0 inch. In other embodiments, the protrusion length 502 may be outside of this range. In the same vein, in one embodiment, the protrusions 300 include a protrusion length 504 that is the same as the protrusion length 502. In other embodiments, the protrusion length 504 may be outside of this range, e.g., between approximately 0.50 to 1.5 inches.

The protrusions 118, 300 can be seen tapering downwardly in a direction toward the upper surface 120 of the anti-splash body 104 and the base 106 to further facilitate the water and/or urine flow. Said another way, the protrusions 118, 300 are wider at the location of the base than at the top. Such configuration causes the protrusions 118, 300 to break up the urine, while simultaneously allowing the urine to strike the upper surface 120 and travel in the downward direction toward the drain when the urinal anti-splash device 100 is disposed in the vertical orientation. The tapering configuration also decreases the complexity associated with the manufacturing process of the device 100 because the protrusions 118, 300 may be relatively simply removed from the molding during the manufacturing process due to the lack of edges. In another embodiments, either the protrusions 118 or the protrusions 300 may include the tapering configuration. In other embodiments, the protrusions 118, 300 may be of a uniform width and devoid of the tapering configuration.

In one embodiment, the urinal anti-splash device 100 may include a fragrance embedded within the material of the urinal anti-splash device 100 during the manufacturing process, e.g., during the extrusion or molding phase of the manufacturing process. In another embodiment, the fragrance may be added to the material using a film process. The fragrance may be a volatile substance, such as a fragrant oil, an odor neutralizer, or the like. Such advantageous embodiments eliminate the need for the use of a room deodorizer or urinal cake that may be inconvenient and costly to consistently replace.

Figure 6:
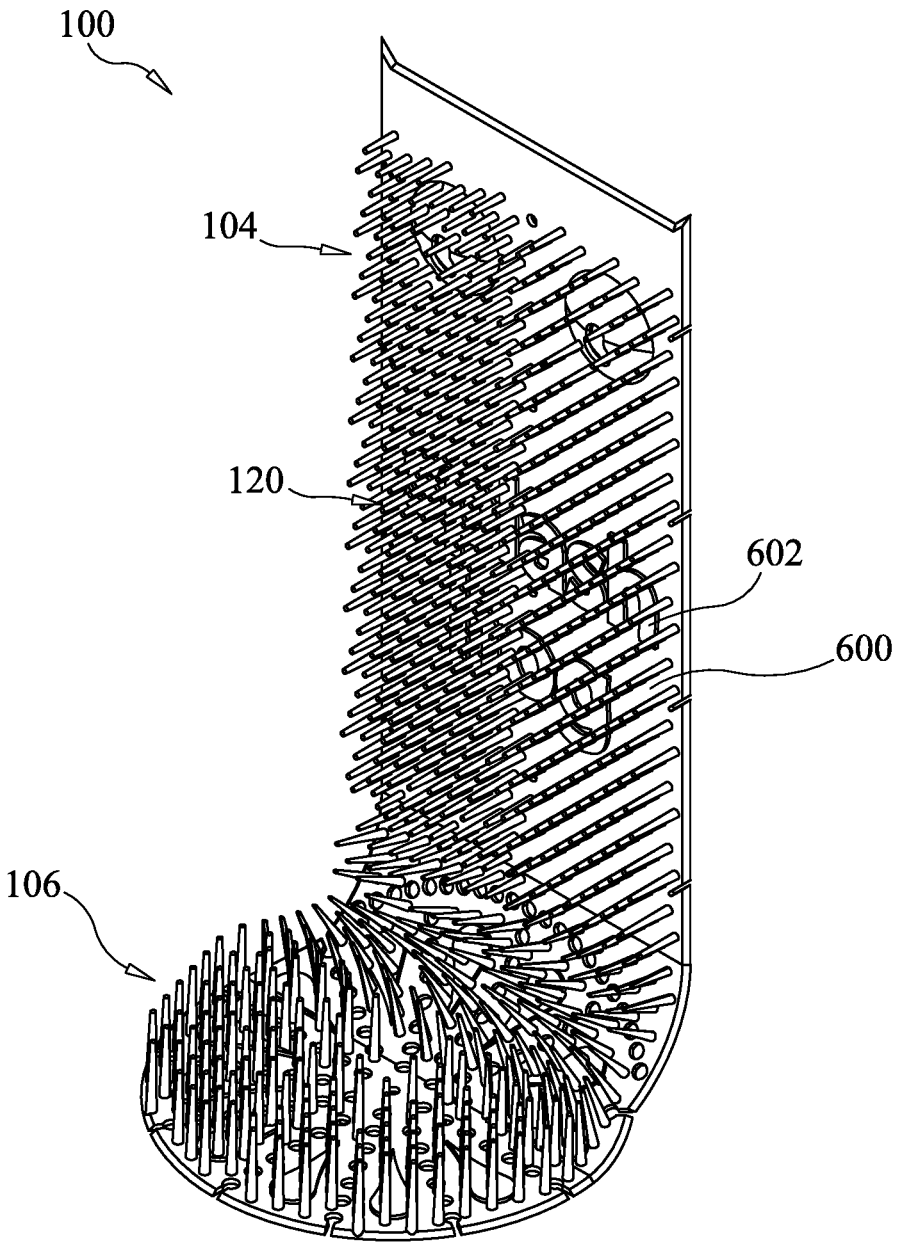
FIG. 6 is a perspective view of the urinal anti-splash device of FIG. 1 depicting the urinal anti-splash device having a thermochromic material added to the urinal anti-splash device in accordance with the present invention.

With reference now to FIG. 6, the anti-splash body 104 is depicted as being coupled to and in the substantially perpendicular orientation relative to the base 106. In one embodiment, the anti-splash body 104 and/or the base 106 made be made with a thermochromic material 600. More specifically, a layer of thermochromic dye may be added to the upper surface 120 of the anti-splash body 104. In a preferred embodiment, the layer of thermochromic dye may be added to the upper surface 120 of the anti-splash body 104 and the base 106. The thermochromic dye may be, without limitation, spirolactone, fluoran, spiropyran, or fulgide, as commonly used by those of ordinary skill in the art. In other embodiments, another type of material may be used to form the thermochromic material 600.

The thermochromic dye provides the user with the urinal anti-splash device 100 that changes color due to a change in temperature, e.g., that which occurs when urine strikes the thermochromic dye on the urinal anti-splash device 100. Advantageously, the thermochromic dye is not only aesthetically appealing, but also allows a viewer, such as maintenance personnel, to observe rinse coverage and the flow of water in order to efficiently and effectively clean the anti-splash device 100. As an added advantage, such configuration also allows businesses to advertise an insignia 602, e.g., a business name and/or logo, which becomes visible when the anti-splash device 100 changes color during use.

Figure 7:
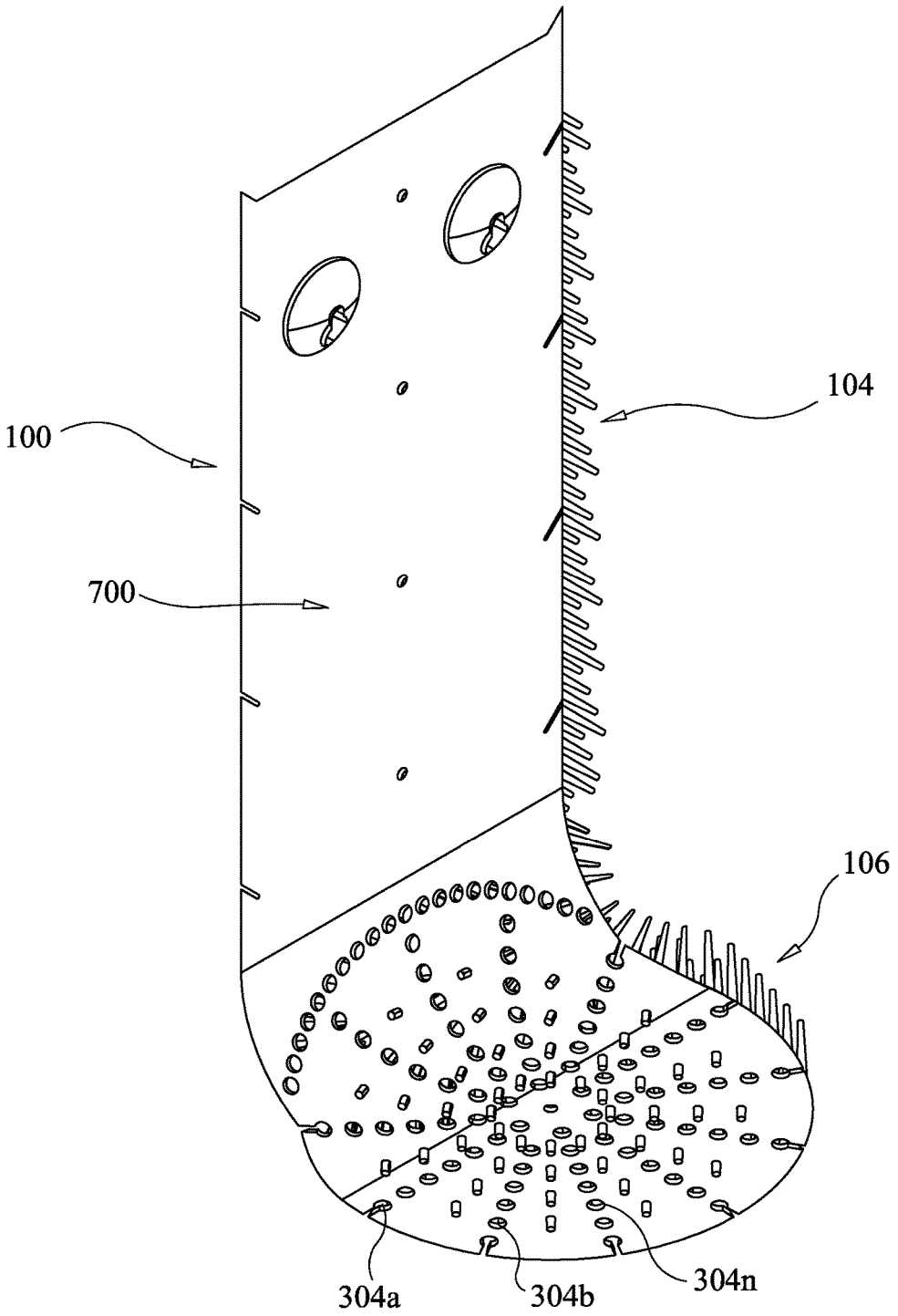
FIG. 7 is a perspective rear view of the urinal anti-splash device of FIG. 1 depicting the anti-splash body having a substantially level rear surface and the base defining a plurality of apertures.

FIG. 7 depicts a perspective rear view of the device 100 showing the anti-splash body 104 having a rear surface 700 that facilitates in the anti-splash body 104 being flush with the back wall 114 of the urinal (FIG. 1). In one embodiment, the rear surface 700 is substantially level with the back wall 114 of the urinal. The term "substantially level" is defined herein as having a relatively flat surface with minimal sloping. In other embodiments, the rear surface 700 may include an uneven rear surface 700, although the level rear surface 700 is preferred.

To effectuate the flow of a stream of urine along the urine flow path from the base 106 in a direction toward the urinal drain, FIG. 7 depicts the apertures 304*a-n* arranged in a substantially linear configuration. The indicator "a-n" is intended to represent any number of items, with "a" indicating 1 and "n" indicating any number greater than 1. The term "substantially linear" is defined herein as arranged in a nearly straight line allowing nominal deviation. The substantially linear configuration of the apertures 304*a-n* forces the stream of urine and/or water to be directed toward the urinal drain. In another embodiments, the apertures 304*a-n* may be arranged in another configuration, e.g., in a deviating configuration with respect to each other.

Figure 8:
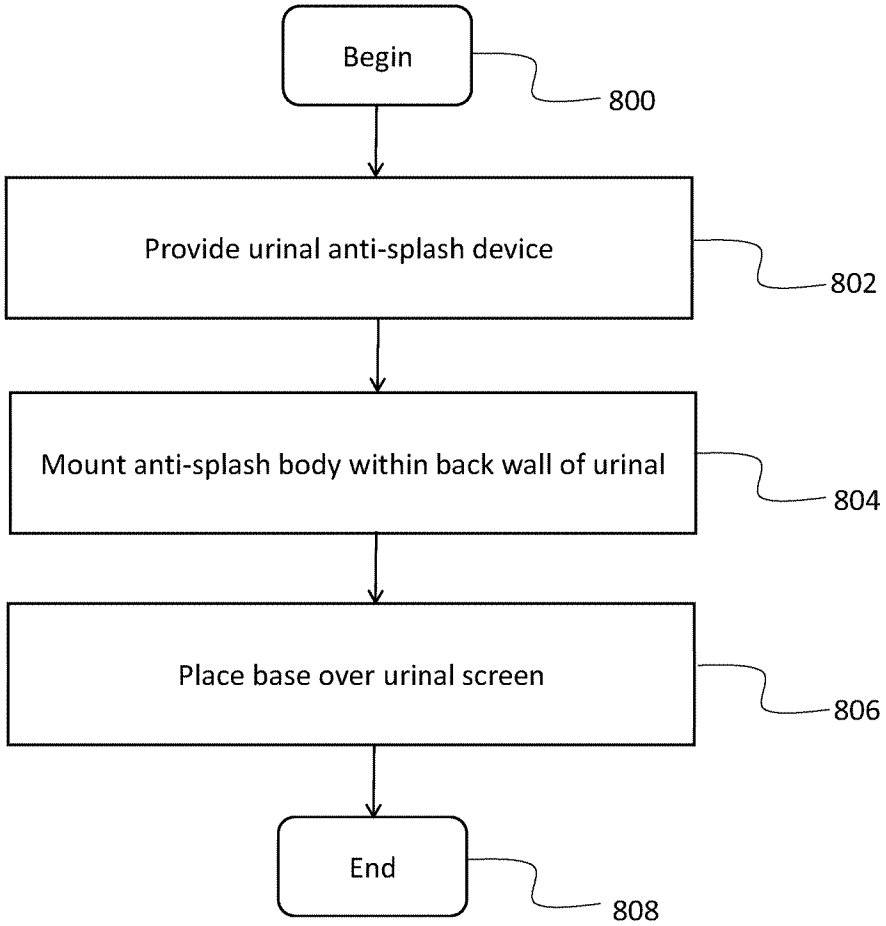
FIG. 8 is a process flow diagram depicting a method of mounting a urinal anti-splash device within a urinal in accordance with one embodiment of the present invention.

With reference now to the process flow chart of FIG. 8, in conjunction with FIGS. 1-7, an exemplary method of mounting a urinal anti-splash device within a urinal is shown. Although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process.

In said process, the method begins as step 800 and immediately proceeds to step 802 of providing a urinal anti-splash device, such as the urinal anti-splash device 100 described above. More specifically, in one embodiment, the urinal anti-splash device 100 includes the anti-splash body 104 coupled to the base 106. As discussed above, the anti-splash body 104 may also include the first plurality of protrusions 118 extending outwardly from the upper surface 120 of the anti-splash body 104 and the second plurality of protrusions 300 extending outwardly from the base 106. The second plurality of protrusions 300 are configured to extend in the direction substantially perpendicular from the first portion 108 of the anti-splash body 104.

In step 804, the process continues with mounting the anti-splash body 104 within a back wall of a urinal. In one embodiment, such mounting may be performed using suctions cups coupled to at least one fastener disposed on the urinal anti-splash device 100. In other embodiments, another type of fastener, e.g., adhesive, tape, hooks, etc., may be used to mount the anti-splash body 104 within the urinal.

Next, the process continues to the step of 806 of placing the base 106 over a urinal screen. Advantageously, in one embodiment, the process includes removably coupling, i.e., separating, the base 106 from the anti-splash body 104 such that the components may be independently positioned within the urinal. Such advantageous embodiment provides the urinal anti-splash device 100 that is not only conducive for placement within different size and shape urinals, but also may cover a portion of the surface area of the urinal, to prevent urine from splashing onto a user. The portion of the surface area of the urinal covered by the anti-splash device 100 may depend on the overall size of the urinal and the relative dimensions of the urinal anti-splash device 100.

In another embodiment, the process may include bending the urinal anti-splash device 100 at a location of a perforated coupling region disposed between the first portion 108 of the anti-splash body 104 and the base 106, as discussed above. The perforated coupling region is configured to translate the base 106 from a first position parallel to the anti-splash body 104 to a second position including the base 106 being in the direction substantially perpendicular from the first portion 108 of the anti-splash body 104. In such configuration the base 106 may remain coupled to the anti-splash body 104, or alternatively, may be detached from the anti-splash body 104. The process then terminates at step 808.

A urinal anti-splash device has been disclosed that not only includes an anti-splash body and a base that may be separated from each other to cover a back wall and a urinal screen to prevent urine from splashing onto a user of the urinal, but also provides an upper surface conducive for allowing the urine and/or water to flow in a downward direction toward the urinal drain.

What is claimed is:

1. A urinal anti-splash device comprising:

an anti-splash body sized and shaped to couple to at least a portion of a urinal, the anti-splash body including:

a first portion;

a second portion opposite the first portion;

a length extending from the first portion to the second portion; and an upper surface extending the length;

a base couplable to the first portion and configured to extend in a direction substantially perpendicular from the first portion;

a first plurality of protrusions extending outwardly from the upper surface of the anti-splash body and which taper downwardly in a direction toward the upper surface of the anti-splash body; and a second plurality of protrusions extending outwardly from the base, the second plurality of protrusions configured to extend in the direction substantially perpendicular from the first portion of the anti-splash body.

2. The urinal anti-splash device according to claim 1, wherein:

the base is of a shape different than a shape of the anti-splash body.

3. The urinal anti-splash device according to claim 1, wherein:

the anti-splash body includes an elongated shape of a flexible material configured to couple to a back wall of a urinal.

4. The urinal anti-splash device according to claim 1, further comprising:

at least one fastener sized and shaped to orient the anti-splash body in a vertical direction parallel to a vertical direction of a urinal wall.

5. The urinal anti-splash device according to claim 1, wherein:

the base is removably coupled to the first portion.

6. The urinal anti-splash device according to claim 1, further comprising:

a perforated coupling region disposed between the first portion of the anti-splash body and the base, the perforated coupling region configured to translate the base from a first position parallel to the anti-splash body to a second position including the base being in the direction substantially perpendicular from the first portion of the anti-splash body.

7. The urinal anti-splash device according to claim 1, wherein:

the base is made of buoyant material.

8. The urinal anti-splash device according to claim 1, wherein:

the anti-splash body is a rectangular-like shape; and the base is a circular-like shape.

9. The urinal anti-splash device according to claim 1, wherein:

the first plurality of protrusions are of a variable length.

10. The urinal anti-splash device according to claim 1, further comprising:

an angled portion at a top of the anti-splash body configured to facilitate flow along the upper surface.

11. A urinal anti-splash device comprising:

an anti-splash body configured to couple to a urinal wall, the anti-splash body including a first portion, a second portion opposite the first portion, and a longitudinal length separating the first portion from the second portion;

a base couplable to the first portion of the anti-splash body, the base sized and shaped to cover at least a portion of a urinal drain;

a coupling region configured to translate the base between a first position including the base oriented in a direction parallel to the anti-splash body and a second position including the base oriented in a direction substantially perpendicular from the base; and a plurality of protrusions coupled to the anti-splash body and the base.

12. The urinal anti-splash device according to claim 11, wherein:

the anti-splash body is of a shape different than a shape of the base.

13. The urinal anti-splash device according to claim 11, wherein:

the base is removably coupled to the anti-splash body.

14. The urinal anti-splash device according to claim 11, wherein:

the coupling region includes a perforated edge.

15. The urinal anti-splash device according to claim 11, wherein:

the plurality of protrusions taper downwardly in a direction toward an upper surface of the anti-splash body and the base.

16. The urinal anti-splash device according to claim 11, wherein:

the plurality of protrusions substantially span the longitudinal length and define a plurality of protrusion voids.

17. The urinal anti-splash device according to claim 11, wherein:

the anti-splash body includes a thermochromic material.

18. A method of mounting a urinal anti-splash device within a urinal comprising:

providing a urinal anti-splash device including:

an anti-splash body sized and shaped to couple to at least a portion of a urinal, the anti-splash body including:

a first portion;

a second portion opposite the first portion;

a longitudinal length extending from the first portion to the second portion; and an upper surface extending the longitudinal length;

a base couplable to the first portion and configured to extend in a direction substantially perpendicular from the first portion;

a coupling region disposed between the first portion of the anti-splash body and the base, the coupling region configured to allow the base to be moved from being substantially parallel to the anti-splash body in a first position to a second position substantially perpendicular to the anti-splash body;

a first plurality of protrusions extending outwardly from the upper surface of the anti-splash body; and a second plurality of protrusions extending outwardly from the base, the second plurality of protrusions configured to extend in the direction substantially perpendicular from the first portion of the anti-splash body;

mounting the anti-splash body within a back wall of a urinal; and placing the base over a urinal screen.

19. The method of mounting a urinal anti-splash device within a urinal according to claim 18, further comprising:

removably coupling the anti-splash body from the base.

20. The method of mounting a urinal anti-splash device within a urinal according to claim 18, further comprising:

bending the urinal anti-splash device at the coupling region.

* * * * *